US005989606A

United States Patent [19]

Sambrailo

[11] Patent Number: 5,989,606

[45] Date of Patent: Nov. 23, 1999

[54] BERRY PACK

[75] Inventor: William K. Sambrailo, Aptos, Calif.

[73] Assignee: Plexiform Company, Watsonville, Calif.

[21] Appl. No.: 08/953,359

[22] Filed: Oct. 17, 1997

[51] Int. Cl.[6] ..... A23B 1/00; B65D 85/00

[52] U.S. Cl. ..... 426/106; 426/124; 206/763; 206/765; 206/488; 206/423; 206/562; 206/521.6; 206/521.8

[58] Field of Search ..... 426/119, 124, 426/106; 206/763, 765, 488, 489, 423, 558, 567, 563, 521.6, 521.8

[56] References Cited

U.S. PATENT DOCUMENTS

D. 332,664 1/1993 Sincock ..... D24/130
3,661,249 5/1972 Clemens ..... 426/124
3,703,383 11/1972 Kuchenbecker ..... 426/106

*Primary Examiner*—Anthony J. Weier
*Attorney, Agent, or Firm*—Morton & Associates

[57] ABSTRACT

Method for the improved packing of stemmed produce in produce containers, and apparatus to perform the method. The present invention teaches a methodology based on the use of a packaging adaptor for insertion into a produce container, such as a berry basket. The adapter is formed as a substantially hollow, box-like structure having at least one and preferably a plurality of apertures defined in an upper surface thereof. The adapter, inserted into the container defines a first, lower compartment and a second, upper compartment. The adapter is inserted in the container, and the stem of the fruit, for instance a strawberry, is inserted therein. The stems are retained in the first compartment and the body of the fruit in the second compartment. In this manner, the relatively soft body of the fruit is precluded from contact with, and damage from, the relatively tough, woody stem portion of fruit.

10 Claims, 2 Drawing Sheets

BERRY PACK

TECHNICAL FIELD

The present invention relates to a method for packing long-stemmed berries in a container in such manner that the damage to the fruit caused by the long stems is minimized. The present invention further teaches an apparatus to perform the method.

BACKGROUND OF THE INVENTION

Strawberries are generally packed as loose berries into baskets, and this packaging form is well known to consumers. Such berries typically packed with little or no stem remaining on the berry. This removal of the stem from the berry is typically conducted by pickers in the field, although sometimes performed by the berry packers.

In addition to the common form of strawberries previously discussed, there exists a premium market for gourmet berries, often used by confectioners. These berries are characterized by having a substantially longer section of stem attached to the berry as it is sold to the user, and are often significantly larger and may be more perfect than berries sold either to the home consumer or to berry processors. The purpose of the elongate stem left attached to the berry is to provide both an improved appearance, and to serve as a handle. The stem in its use as a handle is often employed for dipping the berries into a confection material, for instance chocolate or the like.

A problem exists for the packers of such premium long-stemmed berries in that existing packaging methodologies, for instance the simple use of berry baskets, allow the relatively tough, woody stems to remain in contact with the relatively soft, pulpy flesh of the fruit itself during both packing and transit. This contact between the stems and the flesh often leads to unacceptable levels of fruit damage and ultimately product rejection by the consumer. What is needed is a methodology which isolates the relatively tough, woody stems of berries, especially strawberries, from the relatively soft, pulpy flesh thereof during packing and transit. The methodology should be capable of implementation with a variety of currently existing packaging products. Optimally, the methodology, and the apparatus which practices the methodology, should arrange the berries in an appealing configuration for the end consumer. Additionally, the methodology should be efficient in the use of package volume thereby retaining efficiencies of shipping.

SUMMARY OF THE INVENTION

The present invention teaches a novel adapter, receivable into existing berry baskets, boxes, or other fruit containers. The adapter provides a means for separating the berry basket into a first, lower compartment separated by the adapter from a second, upper compartment. This is enabled by a device further implemented on the adapter, which retains the upper surface of the adapter at some distance from, and substantially parallel to, the bottom of the berry basket or box.

After a berry basket is fitted with one of the adapters taught herein, the berry picker or packer, after having removed the long-stemmed fruit from the plant, inserts the stem through one of the apertures. This has the effect of segregating the relatively woody from the substantially soft fruit. In similar fashion, the packer continues with subsequent berries until the upper chamber is filled with berries. The filled tray then presents a uniform field of berries, bottom up, arrayed in the upper chamber defined by the adapter, and a plurality of long stems, disposed through the apertures in the adapter into the lower chamber. Alternatively, the adapter of the present invention may be loaded with berries and the berry-laden adapter subsequently inserted into the berry basket or container.

Long-stemmed berries packed in accordance with the principles of the present invention are substantially free of the damaging effects previously discussed, and present to the end user a quality, premium berry product either for individual use, or for further processing, for instance as confection-covered berries.

Other features of the present invention are disclosed or apparent in the section entitled, "DETAILED DESCRIPTION OF THE INVENTION".

DETAILED DESCRIPTION OF THE INVENTION

Figure 1:
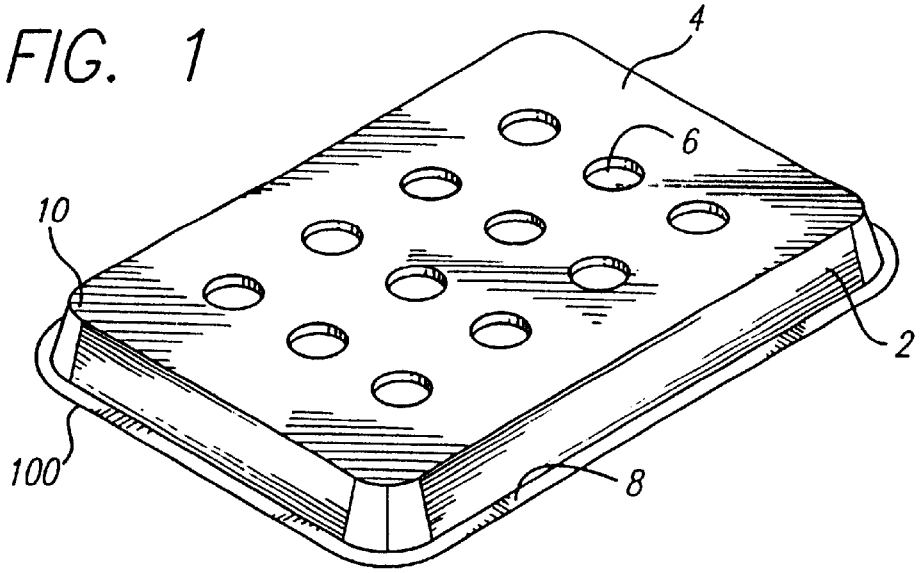
FIG. 1 is a perspective view of the berry basket adapter according to the present invention.

Referring now to FIG. 1, the first preferred embodiment of the berry basket adapter taught by the present invention is shown. In a preferred embodiment of the present invention, adapter 100 comprises a substantially hollow box-like structure including an upper surface 4 and a plurality of side surfaces 2. Upper surface 4 defines at least one, and preferably a plurality of, apertures 6. Upper surface 4 is retained at an elevated distance from a surface upon which adapter 100 is placed by means of a plurality of side surfaces 2, which retain the upper surface 4 at some distance from and substantially parallel to any surface (not shown) adapter 100 is placed. Optionally, adapter 100 may include at least one, and preferably a plurality of rim surfaces 8. Rim surfaces 8 comprise a surface substantially parallel to top surface 4 and are attached to, and preferably formed as a unit with side surface 2. Rim 8 may be a contiguous surface substantially as shown, or may, in the alternative, be formed as at least one and preferably a plurality of discreet surfaces. A corner, 10, is formed at the juncture of each pair of side surfaces 2 and top surface 4. This junction may be rounded or sharply edged. Adapter 100 may be formed of a number of materials including, but not necessarily limited to, plastics, papers, pulp products, metals, foils, corrugated cardboard, pressboard, and other materials well known to those having ordinary skill in the packaging arts. Additionally, adapter 100 may comprise a lower surface, not shown in this figure, substantially parallel to upper surface 4 whereby the lower compartment formed by adapter 100 is enclosed.

Figure 2:
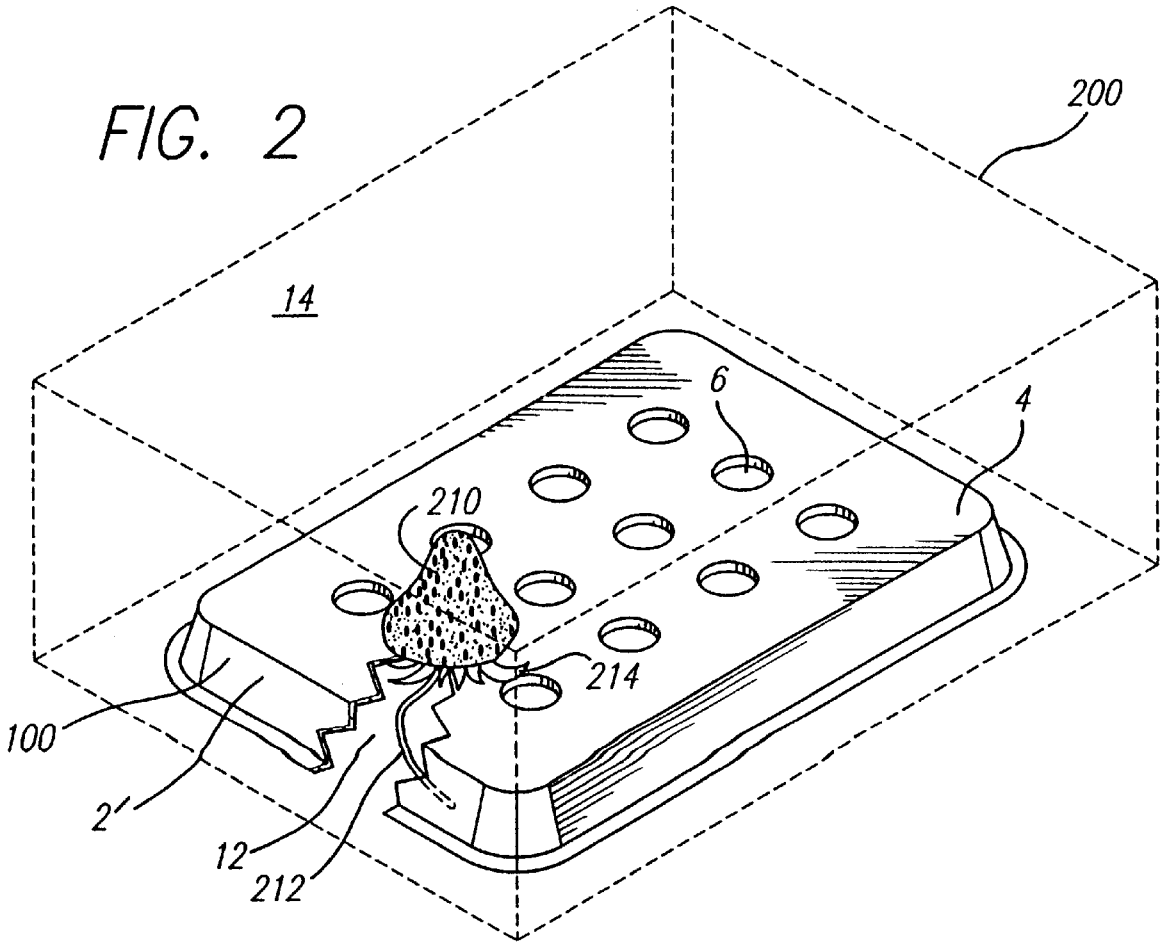
FIG. 2 is a perspective view of an adapter as taught by the present invention inserted in a fruit container, the adapter bearing a berry.

FIG. 2 shows adapter 100 inserted into a berry basket, 200, defined by the dotted lines shown in the figure. Adapter 100 carries a strawberry, 210, on upper surface 4. Strawberry 210 includes an elongated stem section 212 and a calyx 214 formed of individual sepals.

In this figure, a portion of a front surface 2' is shown cut away for purposes of clarity. In use, adapter 100 is preferentially inserted into basket 200 and at least one, and preferably a plurality of berries 210, is installed therein by inserting at least a portion of stem 212 through an aperture 6 and leading the stem into lower compartment 12. In this fashion, the soft, pulpy part of berry 210 is isolated from contact with the relatively tough, woody stem sections, 212, of the berries. Furthermore, the present invention takes advantage of the whorl of sepals which form calyx 214. By storing berries 212 in the inverted manner shown, the weight of the berry is born by contacting not the flesh of the berry, but calyx 214 with upper surface 4. The combination of the substantially resilient calyx 214 with the substantially resilient upper surface 4 results in a particularly effective cushioning of the fruit, further insuring its arrival to the end user in particularly undamaged condition.

The use of adapter 100 segregates the interior of berry basket 200 into the previously discussed lower compartment 12 and upper compartment 14, which upper compartment retains and contains the fruit body of the berry.

Figure 3:
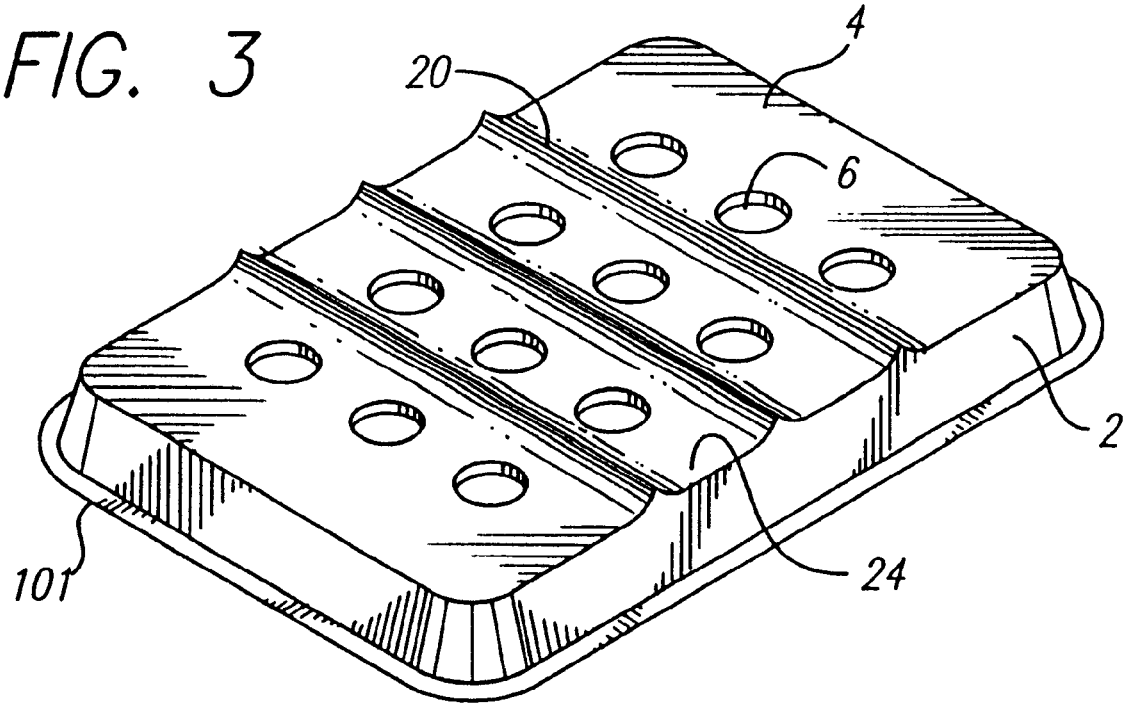
FIG. 3 is an alternative embodiment of the adapter of the present invention.

An alternative embodiment of the present invention is shown at FIG. 3. This embodiment includes a plurality of ridges 20 formed on upper surface 4, ridges 20 defining there between at least one, and preferably a plurality of troughs 24. This embodiment provides a degree of segregation between the several rows of berries stored therein. Additionally, the inclusion of ridges 20 and troughs 24 to upper surface 4 may provide a degree of stiffening for upper surface 4, particularly desirable in large versions of the present invention, or where the adapter of the present invention is utilized for the shipment of heavier fruit.

The present invention has been particularly shown and described with respect to certain preferred embodiments and features thereof. However, it should be readily apparent to those of ordinary skill in the art that various changes and modification in form and detail may be made without departing from the spirit and scope of the invention as set forth in the appended claims. In particular, alternative manufacturing methodologies, plan geometries, materials, trough, cup, and ridge configurations, as well as differences in size and number of apertures in the adapter are all comprehended by the principles of the present invention. The invention disclosed herein may be practiced without any element which is not specifically disclosed herein.

I claim:

1. A berry pack, the berry pack comprising in operative combination:

a stemmed berry fruit;

a berry basket member; and an adaptor member, the adaptor member being insertable in the berry basket member and being shaped for receiving and storing thereon particular weight and configurations of stemmed berry fruit, each configuration of stemmed berry fruit including size and shape thereof, the fruit including at least a pulpy body portion, a calyx portion and a stem portion, the adaptor member comprising an upper surface having at least one aperture for receiving the stem portion and further comprising an alignment means, in operative combination with the upper surface, for elevating the upper surface from a bottom surface of the berry basket member upon being inserted in the berry basket member and thereby forming a first compartment in the berry basket member for housing the stem portion protruding via the at least one aperture and segregating the stem portion from the pulpy body portion and calyx portion, the alignment means also forming a second compartment in the berry basket member for housing the pulpy body portion and calyx portion, the alignment means also retaining the upper surface in substantially parallel alignment with the bottom surface of the berry basket member.

2. The berry pack of claim 1 wherein the alignment means further comprises a plurality of sidewalls.

3. The berry pack of claim 2 further comprising a rim surface in operative combination with at least one of the sidewalls.

4. The berry pack of claim 1 wherein:

the upper surface comprises a plurality of troughs and the at least one aperture comprises a plurality of apertures, the apertures formed on the upper surface are formed in rows at a bottom of each trough member, and each trough member is bounded by a plurality of ridges formed on the upper surface, the ridges effecting a stiffening characteristic to the upper surface and providing segregation between rows of berries stored and supported in respective troughs.

5. The berry pack of claim 1 further comprising a lower surface disposed substantially parallel to the upper surface, and at a distance therefrom, the upper surface and the lower surface defining therebetween the first compartment.

6. The berry pack of claim 1 wherein:

the at least one aperture further comprises a plurality of spaced apart apertures, the apertures being spaced apart by spacing between the several ones of the plurality of apertures defined by the configuration of the fruit to be received therein.

7. The berry pack of claim 1 formed of a flexible material, thereby rendering the upper surface resilient.

8. A berry pack, the berry pack comprising in operative combination:

a stemmed berry fruit;

a berry basket member; and an adaptor member, the adaptor member being insertable in the berry basket member, and being shaped for receiving and storing thereon a particular weight and configuration of stemmed strawberry fruit, the configuration of the fruit including size and shape thereof, the fruit including at least a pulpy body portion, a calyx portion and a stem portion, the adaptor member comprising a resilient upper surface having a plurality of apertures, the spacing between the several ones of the plurality of apertures being defined by the configuration of the fruit to be received thereon, the adaptor member also comprising a plurality of sidewalls, in operative combination with the upper surface, for elevating the upper surface from a bottom surface of the berry basket member and for retaining the upper surface in substantially parallel alignment with the bottom surface of the berry basket member, the adaptor member further comprising a rim surface in operative combination with at least one of the sidewalls, and the adaptor member, upon being inserted within the berry basket member, defines a first and a second compartment, the first compartment defining space for receiving and isolating therein the stem portion of the fruit and the second compartment defining space for receiving and storing the body portion of the fruit, such that the calyx is supported adjacent the resilient upper surface such that the pulpy body portion is cushioned against damage enroute to an end user.

9. The berry pack of claim 8 wherein:

the upper surface comprises a plurality of troughs and the at least one aperture comprises a plurality of apertures, the apertures formed on the upper surface being formed in rows at a bottom of each trough member, and each trough member being bound by a plurality of ridges formed on the upper surface, the ridges effecting a stiffening characteristic to the upper surface and providing segregation between rows of berries stored and supported in respective troughs.

10. The berry pack of claim 8 further comprising a lower surface disposed substantially parallel to the upper surface, and at a distance therefrom, the upper surface and the lower surface defining therebetween the first compartment.

* * * * *